US005676297A

United States Patent [19]

Sawyer et al.

[11] Patent Number: 5,676,297

[45] Date of Patent: Oct. 14, 1997

[54] FILM AND WRAP DISPENSER

[75] Inventors: Graeme Sawyer, Chiswick; David Fulton Francis, Paddington, both of Australia

[73] Assignee: Microwrap International Pty Limited, Chiswick, Australia

[21] Appl. No.: 244,157

[22] PCT Filed: Dec. 23, 1992

[86] PCT No.: PCT/AU92/00677

§ 371 Date: May 17, 1994

§ 102(e) Date: May 17, 1994

[87] PCT Pub. No.: WO93/13003

PCT Pub. Date: Jul. 8, 1993

[30] Foreign Application Priority Data

Dec. 23, 1991 [AU] Australia ..... PL 0154

[51] Int. Cl.[6] ..... B26F 3/12; B65H 35/04

[52] U.S. Cl. ..... 225/21; 225/46; 225/79; 83/171

[58] Field of Search ..... 225/20, 21, 46, 225/47, 51, 79, 87; 83/47, 46, 171

[56] References Cited

U.S. PATENT DOCUMENTS

| | | | |
|---|---|---|---|
| 1,687,594 | 10/1928 | Schneble | 225/79 |
| 1,953,349 | 4/1934 | Jarvis | 225/51 X |
| 1,981,590 | 11/1934 | Easterling | 225/79 X |
| 2,506,504 | 5/1950 | Hudson | 225/79 X |
| 2,668,022 | 2/1954 | Fairfield | 225/51 X |
| 2,793,694 | 5/1957 | Vogt | 225/21 |
| 2,834,646 | 5/1958 | Berg | 225/51 |
| 3,707,251 | 12/1972 | Dashnier et al. | 225/21 |
| 4,427,144 | 1/1984 | Macgrory et al. | 225/20 X |
| 4,840,299 | 6/1989 | Burns | 225/87 X |
| 5,383,590 | 1/1995 | Ho | 225/87 X |

*Primary Examiner*—Rinaldi I. Rada
*Assistant Examiner*—Elizabeth Stanley
*Attorney, Agent, or Firm*—Abelman, Frayne & Schwab

[57] ABSTRACT

A film dispenser includes a housing having bottom, front, rear and side walls and a pivotally mounted top cover. The front wall defines a substantially elongate opening. Film or wrap severing means are provided at or adjacent said opening. An elongate and transversely extending support recess is provided within said housing and rearwardly of the opening, so as to allow for an elongate roll of film or wrap to be located therewithin. A pivotally mounted pressure flap is provided within the housing and is positioned above and apart from said support recess. A roll of film or wrap is adapted to be located within said support recess, with said pressure flap providing a downward pressure thereon.

11 Claims, 4 Drawing Sheets

FILM AND WRAP DISPENSER

BACKGROUND OF PRESENT INVENTION

This invention relates to apparatus for dispensing film and wrap, such as for example plastic film or wrap, polyethylene cling wrap and the like. It is particularly relevant to the dispensing of plastic film or wrap of the kind that is provided in roll form, normally disposed around a cylindrical core.

Cling wraps and films are common household and commercial products, used for example in the packaging of a great diversity of products, including foods, magazines, stationery and many other consumer goods. In many cases, such film or wrap is supplied as a cylindrical roll extending about a core (such as for example a cardboard core). In use, only limited length of film or wrap are required from time to time for any particular use, and thus means are usually provided in association with said rolls of film or wrap, for the cutting of film or wrap as may be desired.

It is common to use cardboard boxes for packaging such film or wrap which have also included a serrated metallic blade on an exterior surface for cutting the film. This has proved to be unsatisfactory in so far as the film often folds up over onto itself (especially due to its inherent clinging nature). Further, such serrated blades often become blunt before the roll of film has been fully used and, being disposable, are not environmentally acceptable to many people.

Alternative methods and arrangements have been proposed whereby containers or housings are provided, which involve the utilisation of severing means in the form of a hot wire, operated by electrical power or battery or the like. This wire is used to quickly melt and cut through the film, causing an even cut across the width of the film. By way of example only, such an arrangement is disclosed in Australian patent specification No 544,232 and U.S. Pat. No. 4,427,144.

While such arrangements are particularly useful and a substantial advance over the use of cardboard containers with serrated edges, disadvantages have been found to exist with such further arrangements. For example, it has been found to be necessary to provide an efficient and straightforward means of pulling the film out of the container, so as to allow the film to be cut by the severing means. It has further been found to be necessary to provide straightforward and efficient means for maintaining sufficient tension and pressure on a roll of film within such a container. By way of example, the effective operation of such containers depends to a large extent upon being able to maintain a suitable pressure and tension on the film at the point where the cut is to occur. Where the tension is too great, the film may be prone to tear unevenly. Alternatively, should tension be insufficient, the film was unlikely to pull away from the wire and in fact can leave a sticky deposit on the wire which can result in future insufficiencies unless the wire or severing means is cleaned.

While the arrangement such as that disclosed in Australian patent specification No 544,232 and U.S. Pat. No. 4,427,144 are particularly advantageous, such arrangements have not overcome the problems outlined above. In other words, they have not enabled film to be maintained at a sufficient tension. One of the problems is that as the film or wrap is used, so too is the diameter of the roll of film or wrap reduced. Also of course, the use of the film results in the mass of the roll being reduced. Thus, surface areas between a roll and the dispensing apparatus and the functional forces thereof are variable while it is desirable that the film tension remains substantially constant.

Some previous attempts to overcome the above problem have been made by attempting to hold the rolls of film or wrap within the internal diameter of the cardboard cores.

That is, by fitting the cores over appropriately formed and dimensioned lugs or axles. While, theoretically this should be possible, given the dimension of the core should remain constant throughout the use of film or wrap, in practice this is not the case. In many cases, such cardboard cores are indented and thus do not efficiently fit (and are not able to be adequately maintained in position) over such lugs or axles.

Further attempts have been made to overcome or minimise the problem outlined above by providing fixing means at a fixed distance apart. This obviously provides problems in that the standard roll length varies from country to country. It is therefore desirable to provide a means whereby the film or wrap being dispensed can be maintained at a relatively constant tension while at the same time being able to accommodate rolls of variable widths.

It is an object of at least one aspect of the present invention to go some way towards overcoming or minimising one or more of the above disadvantages.

Other objects of this invention will become apparent from the following description.

BRIEF SUMMARY OF THE PRESENT INVENTION

According to one aspect of this invention there is provided a film and wrap dispenser including a housing having bottom, front, rear and side walls and a pivotally mounted top cover. The front wall is formed or provided so as to define an elongate opening therein. Film or wrap severing means are provided at or adjacent the elongate opening. An elongate and transversely extending support recess is provided within the housing and rearwardly of the elongate opening, so as to locate therein an elongate roll of film or wrap. An elongate and transversely extending pressure flap is pivotally mounted within the housing and spaced apart above the support recess. The arrangement is such that on location of the roll of film within the support recess, the roll of film is supported and maintained at a desired tension, the pressure flap providing a downward pressure on the roll of film.

According to a further aspect of this invention there is provided a film and wrap dispenser including a housing having bottom, front, rear and side walls and a pivotally mounted top cover. An elongate opening is formed or provided in the front wall and the bottom of the elongate opening is defined by a transversely extending and substantially planar base plate. Elongate film or wrap severing means are provided at or adjacent the elongate opening and extending substantially thereacross. A movable plate is pivotally mounted within the elongate opening and extends into an upwardly extending cover plate having a forward or lead lip portion which in a first position extends over and shrouds the film or wrap severing means. An elongate and transversely extending support recess is provided within the housing and rearwardly of the elongate opening and base plate. The support recess is adapted to locate an elongate roll of film or wrap. And elongate and transversely extending, pivotally mounted, pressure flap extends across and within the housing and above the support recess. The arrangement is such that a roll of film or wrap located within the support recess will have a downward pressure applied thereto from the pressure flap. The arrangement is further such that film or wrap from the roll is fed between the base plate and an underside of the movable plate, with the upwardly extending cover plate and lip covering and shrouding the severing means. On a desired or predetermined amount of film or wrap having been pulled out of the elongate opening, an upward movement applied thereto will cause the movable plate to move and guide said film or wrap upwardly, the cover plate and lip thereby moving to a second position in which the severing means is exposed, so that the film or wrap can come into contact with the severing means to thus cut or sever the predetermined or desired amount of film. The movable plate then returns to a position in juxtaposition with the base plate, and the cover plate and lip return to the first position in which they substantially cover and shroud the severing means.

BRIEF DESCRIPTION OF THE ACCOMPANYING DRAWINGS

This invention will now be described by way of example only and with reference to the accompanying drawings, wherein:

FIG. 1 is a partially exploded sectional view of a dispenser according to one form of the present invention, FIG. 2 is a side sectional view of a dispenser according to one form of the present invention, FIG. 3A is a sectional view of a first position of releasable engagement of stopper lugs with the pressure flap taken on section line 3A,3B-3A,3B of FIG. 1, FIG. 3B is a sectional view of a second position of releasable engagement of stopper lugs with the pressure flap taken on section line 3A,3B-3A,3B of FIG. 1, and FIG. 4 is a perspective view of a dispenser according to one form of the present invention.

DETAILED DESCRIPTION OF PREFERRED EMBODIMENTS OF THE PRESENT INVENTION

Figure 1:
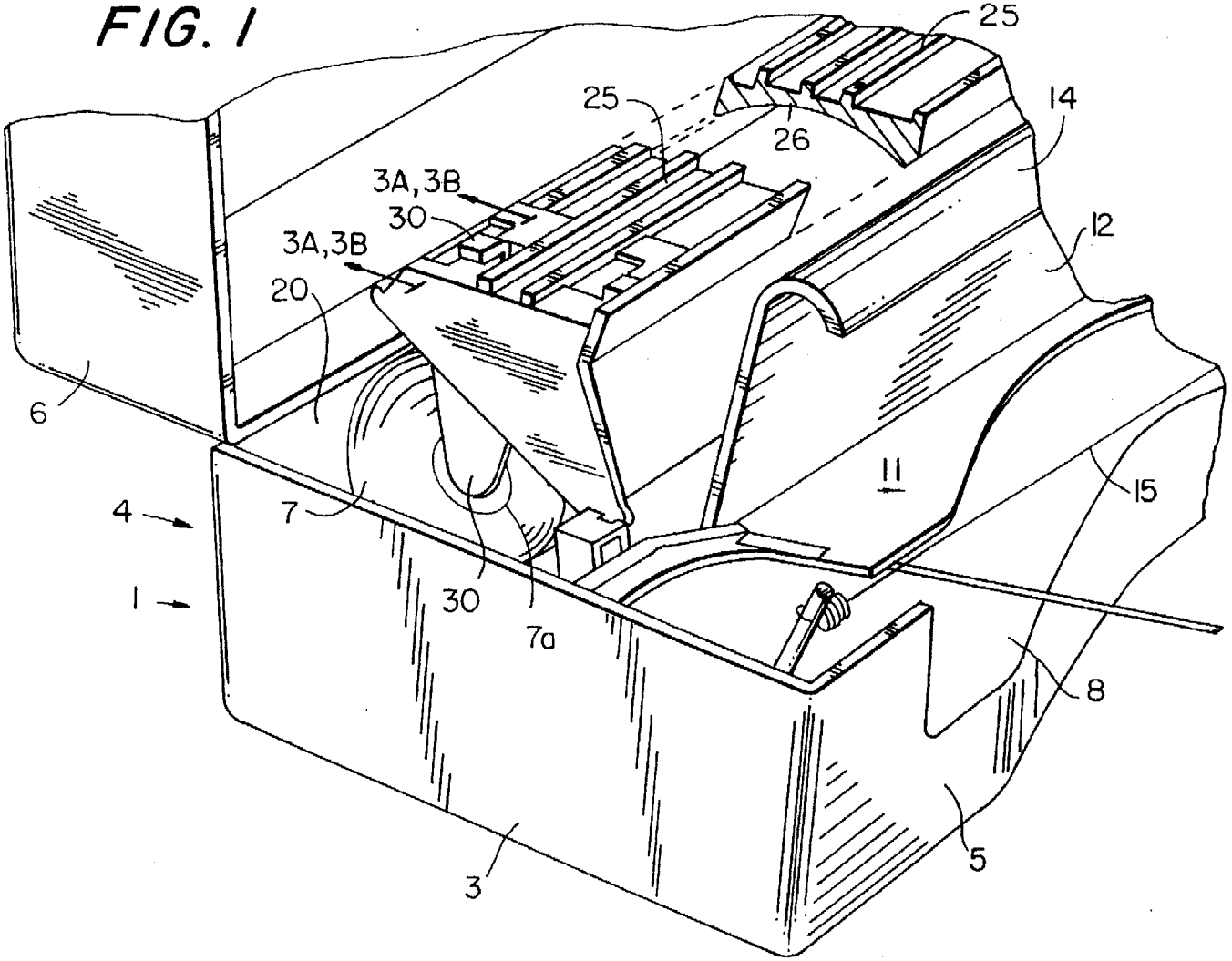

Referring to the accompanying drawings, the dispenser of the present invention includes a housing 1 which has a bottom 2, side walls 3, a rear wall 4 and a front wall 5. A top cover 6 is pivotally mounted to the side walls 3 so that it can be raised to allow for location of a roll of film or wrap 7 (or for example for repair or adjustment) or for removal of an empty core following use of film or wrap. The front wall 5 is provided with an elongate and laterally extending opening 8, which can be provided with grip indents if desired. The housing can be provided and formed of any desired material.

The bottom surface of the opening 8 in the front wall 5 is formed or provided as a substantially planar base plate 10 which can be angled downwardly and which is preferably provided with a roughened or textured surface. Juxtaposed therewith, there is provided a movable plate 11 which extends across the opening 8 and is pivotally mounted to or adjacent sides of the opening 8, the movable plate 11 in its position of rest, being in juxtaposition with and substantially against, the upper surface of the base plate 10.

In the preferred form of the invention as shown in the accompanying drawings, the movable plate 11 extends into and is preferably integrally formed with an upwardly extending and angled cover plate 12 which extends upwardly at an angle from, or adjacent a rear end of the movable plate 11. Thus, the cover plate 12 extends upwardly and over so as to cover the movable plate 11. In the preferred form of the invention as shown in the accompanying drawings, the forward or lead end of the cover plate 12 is provided with a downwardly extending lip portion 14.

While the movable plate 11 and cover plate 12 are preferably integrally formed one with the other, they can be separate integers secured together in an appropriate manner if so desired.

Extending across the opening 8 in the front face is a severing means 15, spaced apart from and above the base plate 10. The severing means 15 is preferably an electrically operated hot wire, which is connected by appropriate contacts to a plug which can be connected to a source of electrical power. Alternatively, the severing means 15 can be connected to one or more batteries or the like. Appropriate switching means can be provided to turn the severing means 15 on or off so that the electrical power will cause the severing means 15 to be heated. Thus, as will be appreciated from the following description, once the film or wrap 7 comes into contact with the severing means 15 (the film or wrap being under appropriate tension), the severing means 15 will cut through or melt through the plastic film or wrap 7 to provide film or wrap of a desired length.

As will be appreciated from the following description, a roll of film or wrap 7 is located within the housing 1 and an end thereof is fed through and between the base plate 10 and underside of the movable plate 11. The ends of the film or wrap 7 are gripped by the hands of a user (such as for example at the grip portions) and the film or wrap 7 is then pulled outwardly from the housing 1. With the movable plate 11 in juxtaposition with the base plate 10, the upwardly extending and angled cover plate 12 and lip 14 extend over and substantially cover and shroud the severing means 15, thus protecting the severing means. However, on a desired or predetermined amount of film or wrap 7 having been pulled out of the housing 1, an upward movement is applied to the film or wrap 7 which causes the movable plate 11 to move upwardly (FIG. 1), guiding the film or wrap 7 upwardly, and at the same time causing the cover plate 12 and lip 14 to move upwardly and rearwardly away from the severing means 15, thus exposing the severing means 15. The film or wrap 7 is then able to be brought up against and into contact with the severing means 15 (the appropriate switch having been turned on to apply power thereto) so that the severing means 15 is essentially a "hot wire", the severing means 15 thereby cutting through and severing the film or wrap 7. Preferably, due to the present invention, the film or wrap 7 is at an appropriate tension so that a clean cut is achieved.

Once the appropriate cut has been made and the film or wrap 7 returned to its position between the base plate 10 and movable plate 11 (without an upward pressure being applied thereto), the movable plate 11 is caused to return to its position in juxtaposition with the base plate 10, which in turn causes the upwardly and outwardly extended cover plate 12 and lip 14 to return to their position in which they essentially cover and shroud the severing means 15.

It is a particular advantage of the present invention that the movable plate 11 is formed and weighted, so that when it is moved upwardly to thereby expose the severing means 15 (and allow for the cutting of the film), it will immediately return to its position of rest, in juxtaposition with the base plate 10. This action immediately removes the film from the severing means (and prevents it from sticking thereto), and also acts to immediately hold the remaining end portion of the film 7 between the base plate 10 and the movable plate 11, for future use. This avoids the film 7 rolling back into the housing and clinging to itself.

As referred to hereinbefore, there have been problems up until this time with locating rolls of film or wrap 7 within such arrangements, such that appropriate tension is applied thereto. It is also desired to securely locate such rolls of film or wrap 7 within the housing, so that appropriate tension can be applied thereto and so that there will be no or minimal lateral movement of rolls of film or wrap. Such lateral movement within containers can effect the efficient dispensing of film or wrap.

As shown in the accompanying drawings, the dispenser 1 of the present invention includes an elongate and transversely extending support recess or valley 20, rearwardly of the base plate 10 and front opening 8, the support recess or valley 20, preferably being arcuately contoured and preferably provided with a textured surface to prevent or minimise static clinging of film thereto. Additionally, if desired, ribs or fins can be provided to form additional profiles or contours to the valley sides.

In a preferred form of the invention as shown in the accompanying drawings, the support recess or valley 20 is integrally formed and moulded with, and leads into, the base plate 10 at the bottom of the opening 8 in the front face of the housing.

Figure 2:
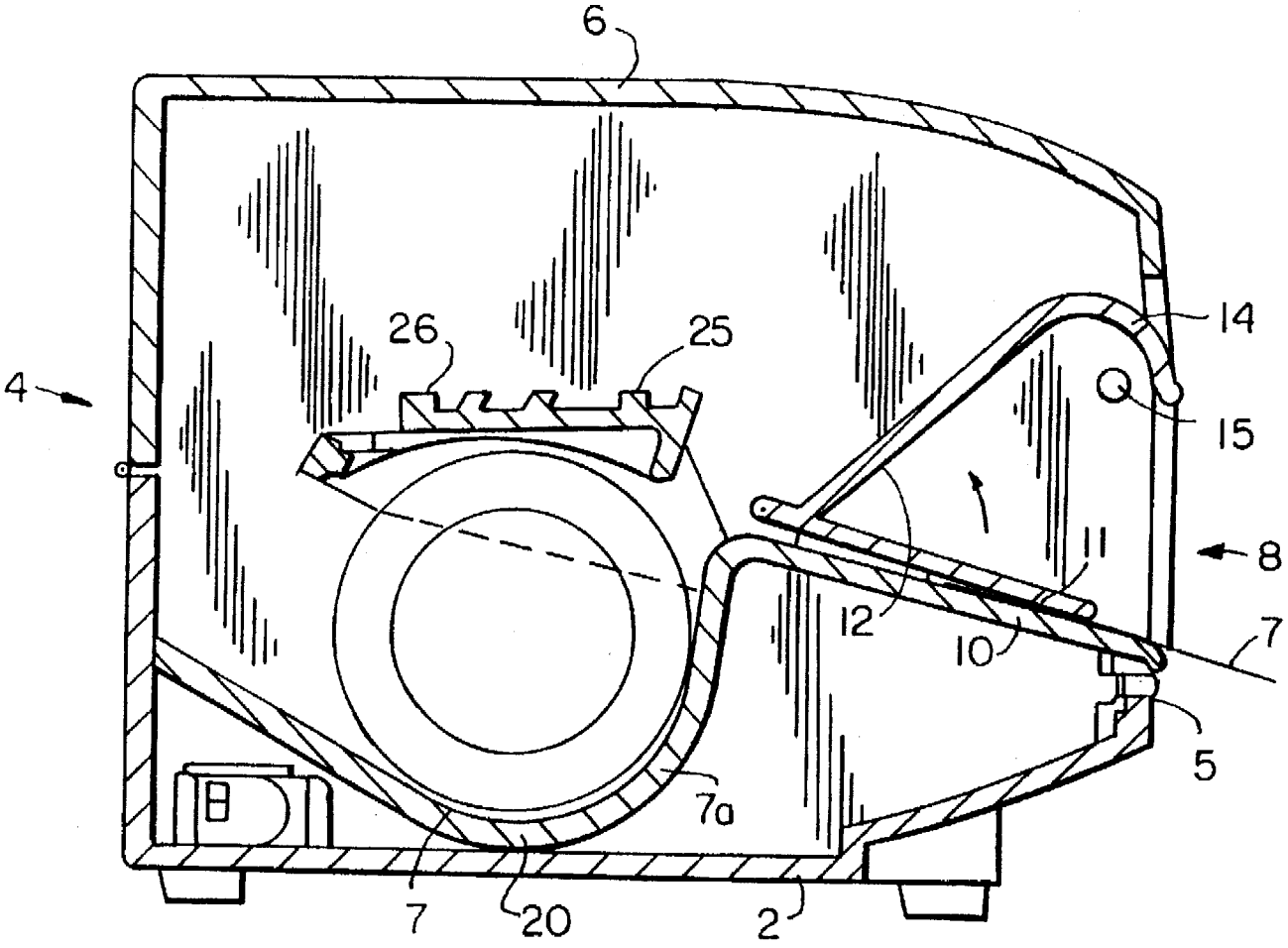

The present invention also provides a pressure flap 25 which is elongate and transversely extending within the housing 1, the pressure flap 25 being pivotally mounted in the housing and being located so as to be spaced apart from and above the support recess or valley 20. In use, as will be appreciated from the accompanying drawings, a roll of film or wrap 7 is located within the support recess or valley 20 (preferably so that the film or wrap is wound out from below the roll (FIG. 2), and so that in this position the pressure flap 25 will be positioned on top of the roll of film or wrap 7 to apply pressure and tension thereto. As the film or wrap is used 7, and the diameter of the film or wrap about the core 7*a* diminishes, the downward pressure on the roll from the pressure flap 25 will be substantially inversely proportioned to the diameter of the roll.

The underside 26 of the pressure flap is preferably substantially arcuate or concave and is preferably provided in one form of the invention with a roughened or textured surface.

In one form of the present invention, adjustable stoppers 30 in the form of downwardly extending stopper lugs are provided at each end of the pressure flap 25 so as to prevent undesired lateral movement of a roll of film or wrap once located within the support recess or valley 20.

One or both of these adjustable stopper lugs 30 can be adjustable, for example to be varied depending upon the length of the roll of film or wrap. In one form of the invention as shown in the accompanying drawings, the adjustable stopper lugs 30 can be engaged by way of a keyhole type engagement system with ends of the pressure flap 25 so as to extend outwardly and downwardly therefrom at each end thereof. In use, this will mean that the lateral movement of a roll of film or wrap 7 between the lugs 30 is substantially limited so as to avoid or at least minimise problems associated with such lateral movement of rolls of film or wrap as experienced up until this time.

Figure 3B:
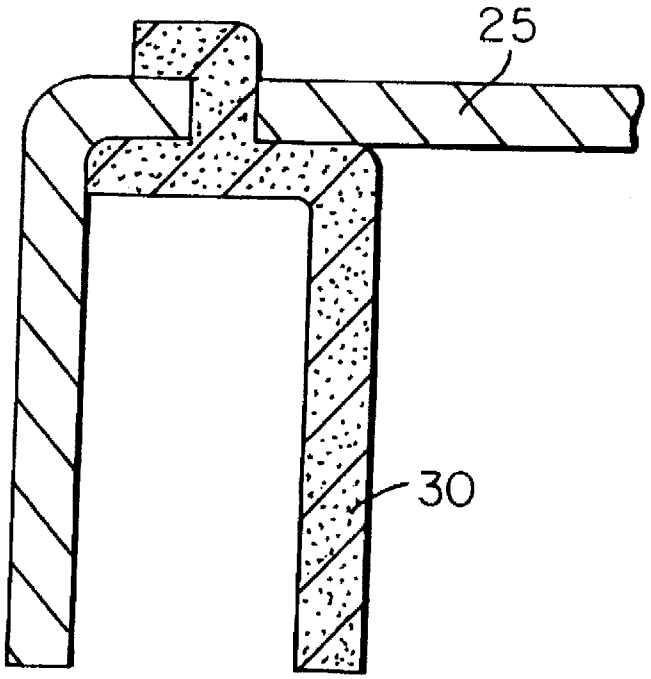
Figure 3A:
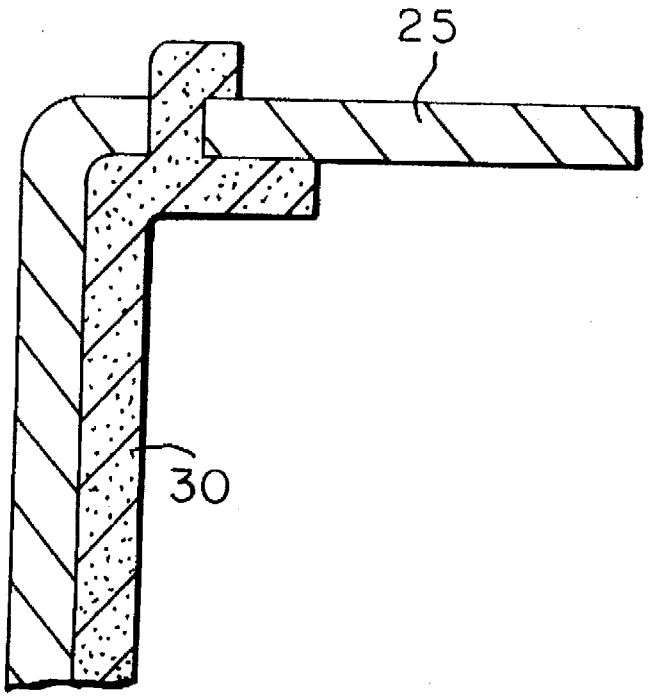
Figure 4:
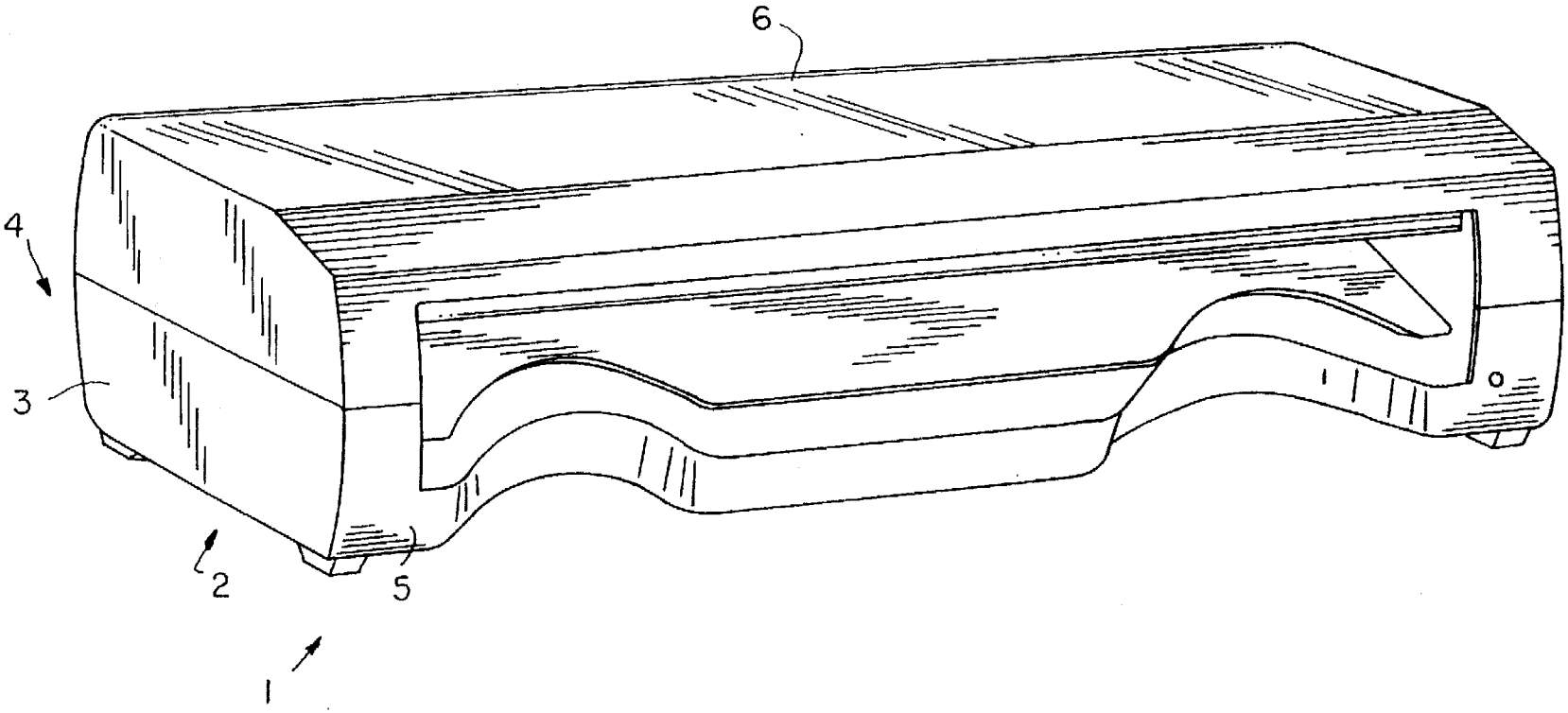

It will be appreciated from FIG. 3A and FIG. 3B of the accompanying drawings, that the lugs can be engaged in at least two different positions, so that the spacing therebetween can be varied so as to accommodate rolls of film or wrap of varying width.

In a further form of the invention, the stopper lugs 30 are fixed and are not adjustable, while still limiting and controlling lateral movement of a roll of film in the support recess 20.

It should be appreciated that other forms of adjustable lugs can be used if desired.

As shown in the accompanying drawings, a roll of film or wrap is located within the support recess or valley 20, which is formed and contoured so as to apply tension to the sides of the film or wrap as the film or wrap is used and thus the diameter increases. The pressure flap 25 maintains a pressure on the upper surface thereof which is substantially inversely proportional to the diameter of the roll.

The present invention has been described by way of example only and it should be appreciated that modifications can be made thereto without departing from the scope thereof as defined by the appended claims.

We claim:

1. A film and wrap dispenser including a housing having bottom, front, rear and side walls and a top cover; said front wall being provided so as to define an elongate opening in said front wall; film and wrap severing means being provided adjacent said opening; an elongate support recess extending substantially perpendicularly to said side walls, said support recess being provided within said housing and being provided rearwardly of said opening, so as to locate therein an elongate roll of wrapping means; an elongate pressure flap extending substantially perpendicularly to said side walls, said pressure flap being pivotally mounted within said housing and being spaced apart above said recess; said pressure flap providing a downward pressure on said roll of wrapping means, thereby maintaining said roll of wrapping means at a desired tension; a substantially planar base plate being provided at a base of said opening in said front wall; the film and wrap severing means extending between said side walls but being spaced apart from and above said base plate; a movable plate being pivotally mounted within said opening; a cover plate extending upwardly from a rear end of said movable plate, an upper end thereof being provided with a downwardly extending lip portion; the movable plate, base plate, cover plate, downwardly extending lip, and severing means being arranged such that with the movable plate in juxtaposition with the base plate, the cover plate and downwardly extending lip extend over and shroud the severing means; the movable plate, cover plate, downwardly extending lip, and severing means being arranged such that after sufficient wrapping means has been removed from said roll, by being pulled out between said base plate and an underside of said movable plate, said wrapping means is moved upwardly so as to cause the movable plate and cover plate to pivot upwardly and rearwardly, thereby exposing the severing means and allowing the wrapping means to come into contact with the severing means to thereby sever a required amount of wrapping means; the movable plate thereafter returning to its position in juxtaposition with the base plate, with the cover plate and lip returning to a position in which they substantially cover and shroud said severing means.

2. A dispenser as claimed in claim 1, wherein said severing means is a heat severing means operated by electrical power.

3. A dispenser as claimed in claim 1, wherein stopper lugs extend downwardly from adjacent each end of said pressure flap.

4. A dispenser as claimed in claim 1, wherein adjustable stopper lugs extend downwardly from adjacent each end of said pressure flap.

5. A dispenser as claimed in claim 1, wherein an underside surface of said pressure flap is of a substantially concave configuration.

6. A dispenser as claimed in claim 1, wherein said base plate extends rearwardly into and is integrally formed with, said support recess.

7. A dispenser as claimed in claim 1, wherein said downward pressure on said roll of wrapping means provided by said pressure flap varies in a substantially inversely proportional manner to the diameter of said roll of wrapping means.

8. A film and wrap dispenser including a housing having bottom, front, rear and side walls and a pivotally mounted top cover; an elongate opening being provided in said front wall and a bottom of said elongate opening being defined by a substantially planar base plate extending between said side walls; elongate film and wrap severing means being provided adjacent said opening and extending substantially thereacross; an upwardly extending cover plate having a forward lip portion which in a first position extends over and shrouds said severing means; a movable plate being pivotally mounted within said opening and extending into said cover plate; an elongate support recess extending substantially perpendicularly to said side walls, said support recess being provided within said housing and being provided rearwardly of said opening and base plate; said support recess being adapted to locate an elongate roll of wrapping means; an elongate pivotally mounted pressure flap extending substantially perpendicularly to said side walls, said pressure flap being within said housing and being above said support recess, such that a roll of wrapping means located within said support recess will have a downward pressure applied thereto from said pressure flap; said film and wrap dispenser being arranged such that wrapping means from said roll is removed from said roll by being pulled out between said base plate and an underside of said movable plate, with said upwardly extending cover plate and lip in said first position, covering and shrouding said severing means; on a desired amount of wrapping means having been pulled out of said opening, an upward movement applied to said wrapping means will cause said movable plate to move and guide said wrapping means upwardly, the cover plate and lip thereby moving to a second position in which said severing means is exposed, so that said wrapping means can come into contact with said severing means to thus sever the desired amount of wrapping means; said movable plate thereafter returning to a position in juxtaposition with said base plate and said cover plate and lip returning to said first position to substantially cover and shroud said severing means.

9. A film and wrap dispenser as claimed in claim 1, wherein said movable plate and said cover plate are integrally formed one with the other, said movable plate being substantially planar; said cover plate extending upwardly and over said movable plate from a rear end thereof and at an angle thereto.

10. A dispenser as claimed in claim 1, wherein said movable plate and said cover plate are integrally formed one with the other.

11. A film and wrap dispenser including:

a housing having bottom, front, rear and side walls and a top cover which together define a recess that extends between and substantially perpendicularly to said side walls, said recess being adapted to accommodate an elongate roll of sheet material;

an elongate opening defined by said front wall through which said sheet material can be withdrawn, a lower boundary of said opening being defined by a substantially planar base plate extending between and substantially perpendicularly to said side walls;

severing means extending between and substantially perpendicularly to said side walls, said severing means being adapted for severing said sheet material and being spaced above said base plate in said opening;

a pressure flap extending between and substantially perpendicularly to said side walls, said pressure flap being located within said recess and mounted in said housing for swinging movement about a pivot axis which is substantially parallel to, above and displaced in a direction parallel to said bottom wall from an axis of a roll of sheet material in the recess so that said flap is adapted to rest upon a top of said roll and increase a tensile force required to pull sheet material from said roll, said pressure flap being located such that, as a diameter of said roll is reduced by a use of the sheet material, a downward pressure on the roll from the pressure flap is increased; and a movable plate extending between and substantially perpendicularly to said side walls, said movable plate having front and rear edge portions, said movable plate being pivotally mounted by said housing so that (i) said front edge portion normally rests upon said base plate to hold the sheet material from the roll between the movable plate and the base plate and (ii), as sheet material is withdrawn upwardly from the opening under tension, the movable plate is pivoted by the sheet material to raise the front edge portion so that the taut sheet material can be brought into contact with said severing means and so that, after severing of the sheet material, the front edge portion is permitted to return to rest upon the base plate to hold the remaining sheet material wherein:

said severing means comprises a taut wire adapted to be heated by electrical power; and a cover plate extends between and substantially perpendicularly to said side walls, said cover plate being affixed to and extending upwardly from the movable plate above and behind said wire, said cover plate having a forwardly and downwardly extending upper lip portion which shields said wire when a front portion of the movable plate rests on said base plate and which, upon raising of the movable plate, is raised to expose said wire to sheet material drawn upwardly under tension from said opening.

* * * * *